United States Patent [19]

Bonne

[11] 4,441,335

[45] Apr. 10, 1984

[54] HEAT PUMP

[75] Inventor: Ulrich Bonne, Hopkins, Minn.

[73] Assignee: Honeywell Inc., Minneapolis, Minn.

[21] Appl. No.: 409,733

[22] Filed: Aug. 19, 1982

[51] Int. Cl.[3] ..... F25B 13/00

[52] U.S. Cl. ..... 62/324.6; 62/160; 137/563

[58] Field of Search ..... 62/160, 324.6; 137/563, 137/561 R

[56] References Cited

U.S. PATENT DOCUMENTS

| | | | |
|---|---|---|---|
| 1,859,427 | 5/1932 | Bulkeley . | |
| 2,077,296 | 4/1937 | Wilkes . | |
| 2,597,729 | 5/1951 | Homeyer . | |
| 2,619,326 | 11/1952 | McLenegan . | |
| 2,713,250 | 7/1955 | Blatchford . | |
| 2,728,197 | 12/1955 | Ellenberger | 62/160 X |
| 2,741,264 | 4/1956 | Leonard . | |
| 2,991,631 | 7/1961 | Ray . | |
| 3,023,592 | 3/1962 | Schordine . | |
| 3,225,557 | 12/1965 | Miller | 62/160 |
| 4,055,056 | 10/1977 | Perkins . | |

*Primary Examiner*—William E. Wayner
*Assistant Examiner*—John Sollecito
*Attorney, Agent, or Firm*—John P. Sumner

[57] ABSTRACT

Disclosed is a reversible refrigeration system comprising a compressor, first and second heat exchangers, an expansion valve, three three-way valves, and apparatus for connecting the elements of the system so that the system will operate in a heating mode with the three-way valves adjusted for heating operation, in a cooling mode with the three three-way valves adjusted for cooling operation and in a defrost mode with the three three-way valves adjusted for defrost operation.

13 Claims, 2 Drawing Figures

HEAT PUMP

BACKGROUND OF THE INVENTION

The present invention relates to a reversible refrigeration system or heat pump. Many current heat pump systems use a four-way, two-position valve which is reversed in order to defrost the system. Such conventional hot gas defrost causes undesirable strong pressure changes and associated oil forming at the compressor. In addition, the four-way, two position valves used in such systems are complex and expensive and have several disadvantages.

One disadvantage of a four-way, two-position or reversing valve is that heat is lost by condition and leakage from the hot and the cold refrigerant lines within the valve. U.S. Pat. No. 2,991,631 recognizes this problem. For example, in column 1, at lines 34–40, the patent notes that "Another important feature of the present invention is that there is a minimum amount of heat transfer between various conduits in the four-way valve to minimize that heat transfer which otherwise would be a dead load on the refrigeration compression system . . .". This heat loss or "dead load" problem can significantly decrease the efficiency of a heat pump system. The present invention substantially eliminates this problem by eliminating the four-way, two-position reversing valve.

Another long standing problem with four-way, two-position valves is leakage of working fluid from the high to low pressure side of the valve. U.S. Pat. No. 2,741,264, line 32 et seq. documents this problem. The present invention employs simpler valves which are more likely to provide leak-free operation.

Four-way, two-position reversing valves also typically have problems associated with unequal thermal expansion of metal parts within the valve, a problem related to the first two problems discussed above. The temperature differential between the suction and discharge lines of the system compressor causes thermal stresses in the four-way valve. That is, the cold portions of the valve tend to expand less (or contract more) than the hot portions. This unequal expansion causes sealing problems and contributes to binding of the moving parts within the valve. U.S. Pat. No. 4,055,056, column 1, line 27, discusses this problem. The valves of the present system do not simultaneously have cold and hot gasses flowing through them and, accordingly, do not undergo thermal straining to as large a degree as the four-way, two-position valves typically used in current systems.

In addition to the above advantages, the present invention provides for a condensor bypass defrost, again without the use of a four-way, two-position reversing valve. Condensor bypass defrost is more reliable than full reverse defrost typically used in four-way valve systems since compressor operating conditions change less abruptly during condensor bypass defrost. Further, in condensor bypass defrost, the first in-rush of hot refrigerant is used to defrost the evaporator rather than to warm up the accumulator, thus increasing defrost efficiency (the accumulator, not shown in FIG. 1, is located at the compressor suction port).

The present invention also provides a stop mode of operation which increases system efficiency by preventing hot, liquid refrigerant from escaping from the evaporator immediately following compressor shut down at the end of a cycle.

SUMMARY OF THE INVENTION

The present invention is a reversible refrigeration system comprising a compressor, first and second heat exchangers, an expansion valve, three three-way valves, and apparatus for connecting the elements of the system so that the system will operate in a heating mode with the three three-way valves adjusted for heating operation, in a cooling mode with the three three-way valves adjusted for cooling operation, and in a defrost mode with the three three-way valves adjusted for defrost operation.

DESCRIPTION OF THE PREFERRED EMBODIMENTS

Figure 1:
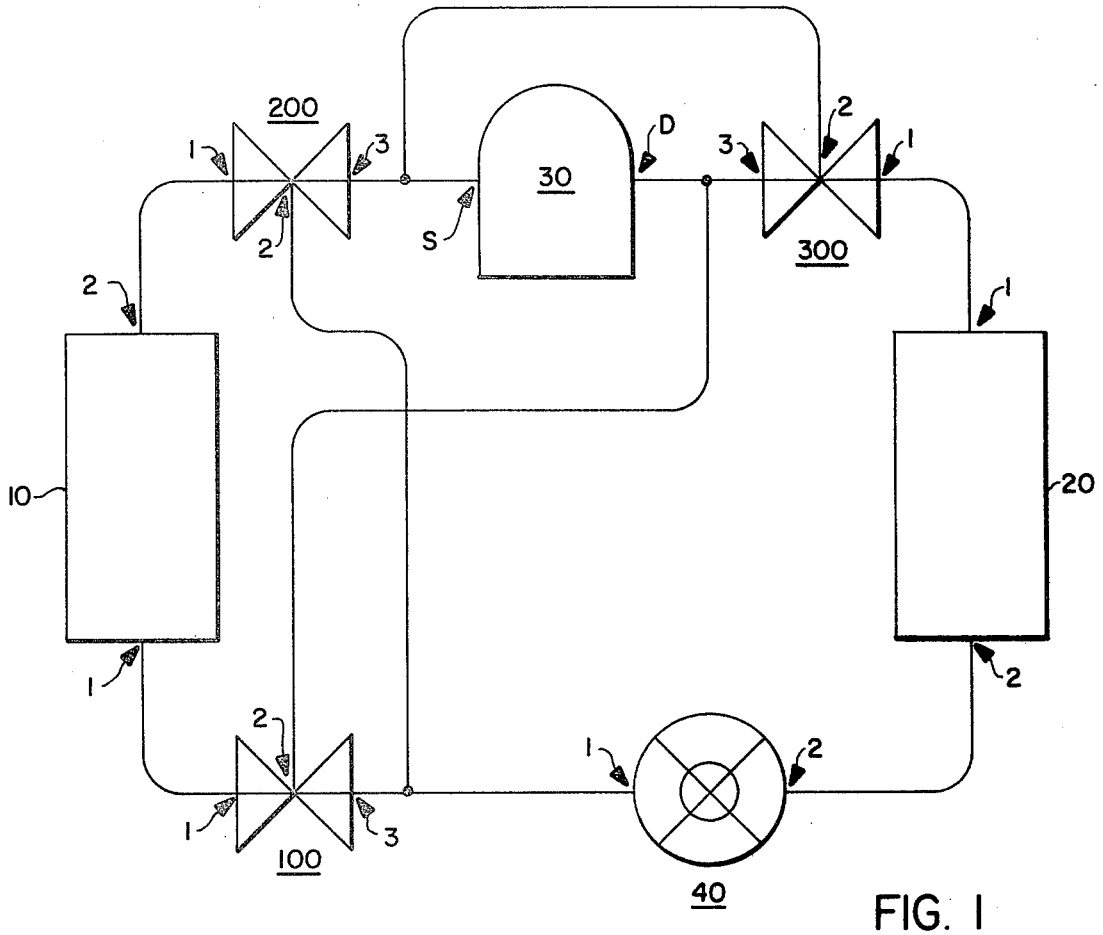
FIG. 1 illustrates a preferred embodiment of the present invention.

As schematically illustrated in FIG. 1, a preferred embodiment of the present invention comprises first and second heat exchangers 10 and 20 which may be, and typically are, identical. Each heat exchanger 10 and 20 operate either as a condensor or as an evaporator, and each comprises first and second ports labeled 1 and 2.

The system further comprises a compressor 30 having a suction port S for intaking refrigerant and a discharge port D for discharging refrigerant at a higher pressure.

The system further comprises an expansion valve 40 for reducing the pressure of the refrigerant, the expansion valve having first and second ports labeled 1 and 2 respectively.

The system as illustrated in FIG. 1 further comprises first, second and third three-way valves labeled 100, 200 and 300 respectively. Each three-way valve has first, second and third ports labeled 1, 2 and 3 respectively.

Although the various ports of the various components are typically interconnected by piping, at least some of these ports may be directly connected without piping in appropriate circumstances. As illustrated in FIG. 1, the first port 1 of first three-way valve 100 is connected to the first port 1 of first heat exchanger 10 via piping. The second port 2 of first three-way valve 100 is connected via piping to the discharge port D of compressor 30, and third port 3 of first three-way valve 100 is connected via piping to first port 1 of expansion valve 40.

Second three-way valve 200 has its first port 1 connected via piping to second port 2 of first heat exchanger 10. The second port 2 of second three-way valve 200 is connected via piping to first port 1 of expansion valve 40, and the third port 3 of second three-way valve 200 is connected to suction port S of compressor 30.

The first port 1 of third three-way valve 300 is connected to the first port 1 of second heat exchanger 20. The second port 2 of third three-way valve 300 is connected via piping to suction port S of compressor 30, and the third port 3 of third three-way valve 300 is connected to discharge port D of compressor 30.

The second port 2 of second heat exchanger 20 is connected to the second port 2 of expansion valve 40.

Each three-way valve 100, 200 and 300 has a first position for permitting refrigerant flow between its first and third ports 1 and 3 respectively, and a second position for permitting refrigerant flow between its first and second ports 1 and 2 respectively.

As more fully explained below, the present system will operate in a heating mode with each of the three-way valves 100, 200 and 300 in the first position. The system will operate in a cooling mode with all three three-way valves 100, 200 and 300 in the second position. The system will operate in a defrost mode with the first three-way valve 100 in the second position and the second and third three-way valves 200 and 300 in the first position.

As previously indicated, in the heating mode of operation, each of the three three-way valves 100, 200 and 300 are in the first position, that is, with refrigerant flowing between the first and third ports 1 and 3 of each of the three valves.

In the heating mode of operation, pressurized refrigerant in its vapor state is discharged by discharge port D of compressor 30. The pressurized refrigerant flows through third three-way valve 300 and into second heat exchanger 20 which would normally be indoors and giving off heat of condensation as the refrigerant is condensed from vapor to liquid form. After the refrigerant is condensed to liquid form in heat exchanger 20, the liquid refrigerant flows out of heat exchanger 20, through expansion valve 40, through first three-way valve 100, and into first heat exchanger 10 which would typically be outdoors and absorbing heat of vaporization to turn the liquid refrigerant into vaporized refrigerant. After vaporizing, refrigerant flows out of heat exchanger 10, through second three-way valve 200, and into suction port S of compressor 30.

Thus, in operating the present system in its heating mode, first heat exchanger 10 operates as an evaporator while second heat exchanger 20 operates as a condensor.

For optimum performance, lines or piping carrying the refrigerant between components are kept well insulated and/or separated, thus minimizing heat transfer from hot to cold lines. As previously mentioned, this is in contrast to prior art systems using four-way, two-position reversing valves in which considerable heat is typically lost between components of the valve.

In using the present system in its cooling mode, all three three-way valves 100, 200 and 300 are in the second position, the second position permitting refrigerant flow between the first and second ports 1 and 2 of the three valves.

In the cooling mode of operation, pressurized refrigerant leaves discharge port D of compressor 30, flows through first three-way valve 100, and enters first heat exchanger 10 which is normally outdoors and looses heat of condensation to the environment as the refrigerant is turned from vapor to liquid. After condensing in heat exchanger 10, the refrigerant flows through second three-way valve 200, through expansion valve 40, and into second heat exchanger 20 which is normally indoors and absorbing heat of vaporization as the liquid refrigerant is vaporized. After vaporizing, the refrigerant flows out of second heat exchanger 20, through third three-way valve 300, and into suction port S of compressor 30.

Thus, in its cooling mode of operation, first heat exchanger 10 operates as a condensor and second heat exchanger 20 operates as an evaporator. Note again that, for optimum performance, lines or piping carrying the refrigerant are kept well insulated and/or separated, thus minimizing heat transfer from hot to cold lines.

As previously mentioned, the present system may be defrosted in a condensor bypass defrost mode. This mode is made operational by placing first three-way valve 100 in the second position (for flow between the first and second ports 1 and 2) and the second and third three-way valves 200 and 300 in the first position (for flow between the first and third ports 1 and 3).

In the condensor bypass defrost mode, compressed vaporized refrigerant is discharged from discharge port D of compressor 30. The refrigerant then passes through first three-way valve 100, through first heat exchanger 10, through second three-way valve 200 and into suction port S of compressor 30. This continuous flow of hot vaporized refrigerant through first heat exchanger 10 melts the frost from the outside of heat exchanger 10, the exchanger that is prone to frost problems when its temperature of operation is lower than water freezing temperature.

Such a method of defrosting condensor 10 has advantages over more typical systems that use a four-way, two-position reversing valve; such systems defrost the condensor by reversing the four-way valve so that the condensor becomes the evaporator and the frost melts away. Such prior art defrosting techniques cause considerable undesirable pressure changes and associated oil foaming in the compressor, and subsequent oil removal by being carried with the refrigerant stream. In addition, such defrost techniques also necessitate the tempering or heating of air flowing past the indoor heat exchanger since otherwise the heat pump will cool the indoor air.

Thus, through the present invention, the defrost mode does not require tempering of indoor air during the defrost mode since the indoor heat exchanger is not functioning as an evaporator. In addition, since third three-way valve 300 is in its first position during defrost (thus permitting refrigerant flow between ports 1 and 3), its hot refrigerant content is also available to defrost evaporator or heat exchanger 10.

The present invention is also capable of being used in a stop mode, which is effected when compressor 30 is turned off. The objective of a stop mode is to substantially prevent hot refrigerant from escaping from heat exchanger 20 so that the indoor/outdoor temperature differential (the temperature differential between heat exchangers 10 and 20) can be maintained for as long as possible without turning on the compressor. In providing a stop mode within the present system, two alternatives described below are available.

In the system thus far described, three-way valves 100, 200 and 300 each required only two positions, a first position for providing fluid flow between first and third ports 1 and 3 and a second position for providing fluid flow between first and second ports 1 and 2. By providing first and second three-way valves 100 and 200 with a third closed position for preventing refrigerant flow through these valves, a stop mode of operation may be obtained by closing valves 100 and 200. This prevents refrigerant flow between heat exchangers 10 and 20 and maximizes stop mode temperature differential between heat exchangers 10 and 20 over a period of time without operating compressor 30 (as previously noted, compressor 30 is shut off during a stop mode). For the stop mode of operation using closable valves 100 and 200, third three-way valve 300 may be left in either of its first or second positions (it would normally be easiest to leave three-way valve 300 in the same position as it was in prior to selecting the stop mode).

Figure 2:
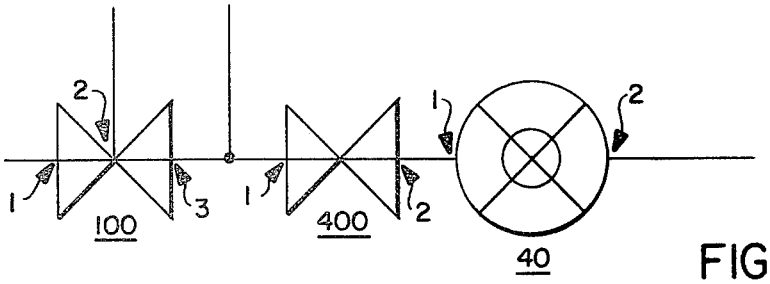
FIG. 2 illustrates the location of an optional valve in an alternate preferred embodiment of the present invention.

In an alternate approach to obtaining a stop mode of operation with the present system, all three three-way valves may remain as two position valves as previously described provided that a two-way valve 400 is inserted in the system. Two-way valve 400 may be added in either of two locations. In FIG. 2, two-way valve 400 is shown inserted between three-way valve 100 and expansion valve 40, a first port 1 of two-way valve 400 being connected to a third port 3 of first three-way valve 100, and a second port 2 of two-way valve 400 connected to the first port 1 of expansion valve 40. Alternately, two-way valve 400 may be connected between expansion valve 40 and second heat exchanger 20. Although this arrangement is not illustrated, it could be implemented by connecting first port 1 of two-way valve 400 to second port 2 of expansion valve 40 and by connecting second port 2 of valve 400 to second port 2 of second heat exchanger 20.

Two-way valve 400 has an open position for permitting refrigerant to flow between its first port 1 and its second port 2 and a second position for preventing refrigerant flow through the valve. By having two-way valve 400 in its open position, one of the heating, cooling or defrosting modes of operation may be selected as previously described. By having the two-way valve in its closed position, a stop mode of operation is obtained, thereby preventing refrigerant flow between heat exchangers 10 and 20 and maximizing stop mode temperature differential between heat exchangers 10 and 20 over a period of time without operating compressor 30, thus reducing heat pump cycling energy losses.

Accordingly, either approach to obtaining stop modes of operation into the present system may be easily implemented in order to maximize the temperature differential between the heat exchangers without operating the compressor, thus increasing system efficiency. As previously described, if no stop mode of operation is available, refrigerant can communicate between the two heat exchangers with a resultant loss of heat.

The present invention is to be limited solely in accordance with the scope of the appended claims since others skilled in the art may devise other embodiments still within the limits of the claims.

The embodiments of the invention in which an exclusive property or right is claimed are defined as follows:

1. A reversible refrigeration system comprising a compressor, first and second heat exchangers, an expansion valve, three three-way valves, and means for connecting the elements of the system so that the system will operate in a heating mode with the three three-way valves adjusted for heating operation, in a cooling mode with the three three-way valves adjusted for cooling operation, and in a defrost mode with the three three-way valves adjusted for defrost operation.

2. The apparatus of claim 1 wherein each of the three three-way valves have two positions for adjusting flow in two alternate ways.

3. A reversible refrigeration system comprising a compressor, first and second heat exchangers, an expansion valve, three three-way valves, and means for connecting the elements of the system so that the system will be in a heating mode with the three three-way valves adjusted for heating operation, in a cooling mode with the three three-way valves adjusted for cooling operation, in a defrost mode with the three three-way valves adjusted for defrost operation, and in a stop mode with the three three-way valves adjusted for stop mode.

4. The apparatus of claim 3 wherein each of the three three-way valves have two positions for adjusting flow in two alternate ways and wherein two of the three-way valves have a closed position for preventing flow through the two valves.

5. A reversible refrigeration system comprising a compressor, first and second heat exchangers, an expansion valve and three three-way valves, each three-way valve having first, second, and third ports, each three-way valve having a first position for permitting flow between its first and third ports and a second position for permitting flow between its first and second ports, the system further comprising means for connecting the elements of the system so that the system will operate in a heating mode with all three three-way valves in the first position, in a cooling mode with all three three-way valves in the second position, and in a defrost mode with the first three-way valve in the second position and the second and third three-way valves in the first position.

6. The apparatus of claim 8 wherein the first and second three-way valves each have a third closed position for preventing flow through the first and second three-way valves so that, by closing the first and second three-way valves, the system is put into a stop mode.

7. The apparatus of claim 1, 3, or 5 wherein the expansion valve comprises a two-way valve having an open position for permitting flow through the two-way valve and a closed position for preventing flow through the two-way valve so that, by putting the two-way valve in its closed position, a stop mode of operation may be obtained.

8. A reversible refrigeration system, comprising:

compressor means having suction port means for intaking refrigerant and discharge port means for discharging refrigerant at a higher pressure;

first and second heat exchanger means for exchanging heat of the refrigerant with the environment, each heat exchanger means having first and second port means for passing the refrigerant through the heat exchanger means;

expansion valve means for reducing the pressure of the refrigerant, the expansion valve means having first and second port means for passing the refrigerant through the expansion valve means;

first three-way valve means having first port means connected to the first port means of the first heat exchanger means, second port means connected to the discharge port means of the compressor means, and third port means connected the first port means of the expansion valve means;

second three-way valve means having first port means connected to the second port means of the first heat exchanger means, second port means connected to the first port means of the expansion valve means, the third port means connected to the suction port means of the compressor means;

third three-way valve means having first port means connected to the first port means of the second heat exchanger means, second port means connected to the suction port means of the compressor means, and third port means connected to the discharge port means of the compressor means;

the second port means of the second heat exchanger means being connected to second port means of the expansion valve means;

each three-way valve means having a first position for permitting refrigerant flow between its first and third port means and a second position for permitting refrigerant flow between its first and second port means;

whereby the system will operate in a heating mode with all three three-way valve means in the first position, in a cooling mode with all three-way valve means in the second position, and in a defrost mode with the first three-way valve means in the second position and the second and third three-way valve means in the first position.

9. The apparatus of claim 8 wherein the first and second three-way valve means each have a third closed position for preventing refrigerant flow through the first and second three-way valve means whereby, through closing the first and second three-way valve means, the system is put into a stop mode of operation, thereby preventing refrigerant flow between the heat exchanger means and maximizing stop mode temperature differential between the heat exchanger means over a period of time without operating the compressor means.

10. The apparatus of claim 8 wherein one of the first and second port means of the expansion valve means comprises two-way valve means having an open position for permitting refrigerant flow through the two-way valve means and a closed position for preventing refrigerant flow through the two-way valve means, whereby one of the heating, cooling and defrosting modes may be selected by having the two-way valve means in its open position and whereby, through having the two-way valve means in its closed position, a stop mode of operation may be obtained, thereby preventing refrigerant flow between the heat exchanger means and maximizing stop mode temperature differential between the heat exchanger means over a period of time without operating the compressor means.

11. The apparatus of claim 8, 9, or 10 wherein each of a plurality of the port means comprises piping means for carrying the flow of refrigerant between a plurality of the port means.

12. The apparatus of claim 11 wherein piping means carrying hot and cold refrigerant are substantially thermally isolated to substantially prevent thermal exchange between the piping means, thereby minimizing heat loss between the piping means.

13. The apparatus of claim 11 wherein the substantial thermal isolation is achieved at least in part by physically separating the piping means carrying the hot and cold refrigerant.

* * * * *

UNITED STATES PATENT AND TRADEMARK OFFICE

CERTIFICATE OF CORRECTION

PATENT NO. : 4,441,335

DATED : April 10, 1984

INVENTOR(S) : Ulrich Bonne

It is certified that error appears in the above-identified patent and that said Letters Patent is hereby corrected as shown below:

Column 6, line 24, "8" should be --5--.

Signed and Sealed this

*Twelfth* Day of *June 1984*

[SEAL]

*Attest:*

GERALD J. MOSSINGHOFF

*Attesting Officer*

*Commissioner of Patents and Trademarks*